US007516853B1

(12) United States Patent
Murillo, Jr.

(10) Patent No.: US 7,516,853 B1
(45) Date of Patent: Apr. 14, 2009

(54) AUXILIARY SHELF SYSTEM

(76) Inventor: Hector A. Murillo, Jr., 2402 Clara La., San Antonio, TX (US) 78213

( * ) Notice: Subject to any disclaimer, the term of this patent is extended or adjusted under 35 U.S.C. 154(b) by 255 days.

(21) Appl. No.: 11/031,627

(22) Filed: Jan. 8, 2005

Related U.S. Application Data

(60) Provisional application No. 60/535,527, filed on Jan. 9, 2004.

(51) Int. Cl.
*A47B 43/00* (2006.01)

(52) U.S. Cl. ..... 211/90.01; 211/188; 211/194

(58) Field of Classification Search ..... 211/90.01, 211/194, 41.11, 49.1, 126.1, 126.2, 188, 211/85.17; 220/4.21, 4.24; 206/509, 511, 206/512; 312/117, 114, 234.5, 140, 234.1, 312/234.3
See application file for complete search history.

(56) References Cited

U.S. PATENT DOCUMENTS 2,997,201 A * 8/1961 Da Prato ..... 206/509
3,375,935 A 4/1968 Whyte
4,283,099 A 8/1981 Burton
4,444,320 A 4/1984 Chap
4,469,231 A 9/1984 Hehn
5,186,340 A 2/1993 Vardaro
5,473,845 A * 12/1995 Livingston et al. ..... 52/79.9
5,630,658 A * 5/1997 Jeter ..... 312/107
5,685,439 A * 11/1997 Luenser ..... 211/183
5,906,801 A * 5/1999 Goughnour ..... 422/300
5,949,653 A * 9/1999 Weng ..... 361/735
6,007,167 A * 12/1999 Cohen ..... 312/9.48
6,615,994 B2 * 9/2003 Cu, Jr. ..... 211/41.18
6,685,036 B2 * 2/2004 de Jenlis et al. ..... 211/59.4
6,749,070 B2 * 6/2004 Corbett et al. ..... 211/26
6,997,335 B2 * 2/2006 Irwin ..... 211/90.01
2004/0084387 A1 * 5/2004 Chang ..... 211/11

* cited by examiner

*Primary Examiner*—Jennifer E. Novosad
(74) *Attorney, Agent, or Firm*—Kenneth L Tolar

(57) ABSTRACT

An auxiliary shelving system for increasing the capacity and safety associated with conventional storage shelves includes a horizontal top wall having a pair of sidewalls depending therefrom. Each sidewall terminates at a lower edge having an inwardly extending lip. Each lip includes a plurality of pegs that can be inserted into apertures on store shelving or on the top wall of another shelf allowing the devices to be securely stacked. The configuration of the auxiliary shelf enclosures can be varied to include front, rear or lower walls.

2 Claims, 3 Drawing Sheets

AUXILIARY SHELF SYSTEM

CROSS REFERENCE TO RELATED APPLICATIONS

This application is entitled to the benefit of provisional application No. 60/535,527 filed on Jan. 9, 2004.

BACKGROUND OF THE INVENTION

The present invention relates to an auxiliary shelf system for use with an existing gondola type shelf to increase the storage capacity thereof.

DESCRIPTION OF THE PRIOR ART

Many department stores and other retailers employ gondola type shelving systems. However, due to the irregular shape and size of some products, they cannot be conveniently or safely stacked on such shelves. Furthermore, it is typically unsafe to stack items on a top shelf because the items are susceptible to falling causing damage and personal injury. Accordingly, the storage capacity of the shelves is significantly diminished.

Many shelf systems exist in the prior art. For example, U.S. Pat. No. 3,375,935 issued to Whyte discloses a file box assembly constructed with cardboard which can be easily disassembled for storage.

U.S. Pat. No. 4,283,099 issued to Burton discloses a cabinet for installation within a school locker.

U.S. Pat. No. 4,444,320 issued to Chap discloses a stackable shelf unit formed of plastic coated metal wire including a pair of side frame members depending from a wire shelf member. Each side frame member includes a downwardly depending leg for engaging a similar shelf unit allowing multiple shelf units to be stacked.

U.S. Pat. No. 5,186,340 issued to Vardaro discloses a modular interlocking tray structure including a plurality of individual trays each of which is adapted for releasable interengagement with a similar tray.

U.S. Pat. No. 4,469,231 issued to Hehn discloses a desk top storage unit including three separate interlocking shelf units.

As indicated above, numerous stacking shelf assemblies exist in the prior art. However, none of the above referenced patents disclose a shelf assembly for use with an existing gondola type shelf assembly as does the present invention. The present invention provides a uniquely designed auxiliary shelf system for use with a gondola type shelf that increases the versatility and capacity thereof.

SUMMARY OF THE INVENTION

The present invention relates to an auxiliary shelf system particularly designed for use with a gondola type shelf. The device comprises an enclosure having a substantially U-shaped cross-sectional configuration including a horizontal top wall with a pair of sidewalls perpendicularly depending therefrom. The sidewalls each terminate at a lower edge. Inwardly extending from the lower edge of each sidewall is a horizontal lip member. On the lower surface of each lip member are one or more pegs for inserting into apertures normally found on gondola shelves to anchor the enclosure thereon. Additionally, apertures are positioned on the top wall to receive the pegs on the lower lip allowing a multiplicity of units to be fixedly stacked, if desired. Angularly extending from a front edge of the top panel is an elongated receptacle for slideably receiving pricing or other informational placards. Preferably, elongated ridges are integrally formed with the upper surface of the top wall to enhance the structural integrity thereof.

The above described auxiliary shelf could include a horizontal lower wall in lieu of the inwardly extending lips thereby providing a box-like enclosure. Other variations include a substantially U-shaped enclosure whereby the sidewalls terminate at a lower edge having a rubber strip thereon or a box-type enclosure having one or more front panels that can be locked to secure controlled merchandise.

It is therefore an object of the present invention to provide a shelf assembly that greatly increases the storage capacity of conventional storage shelving.

It is another object of the present invention to provide an auxiliary shelf system that enhances the safety associated with the use of conventional store shelving.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
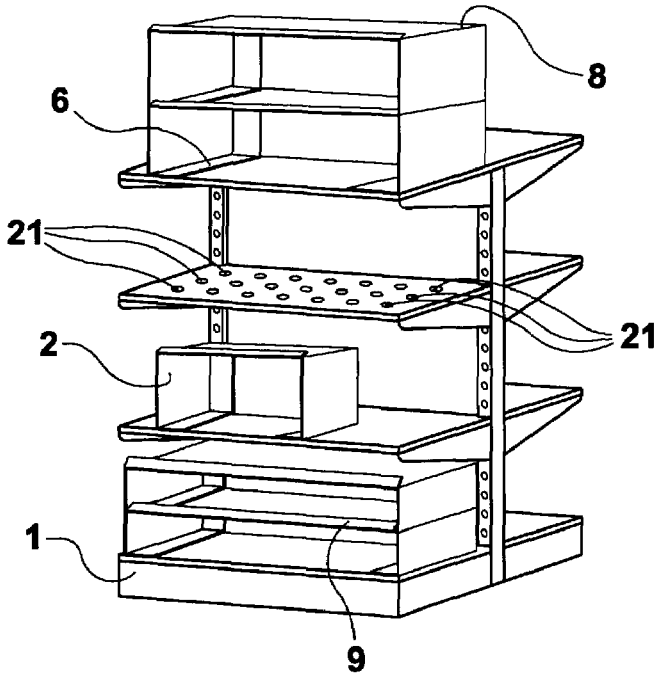
FIG. 1 depicts the auxiliary shelves according to the present invention mounted on a conventional storage shelf system.
Figure 4:
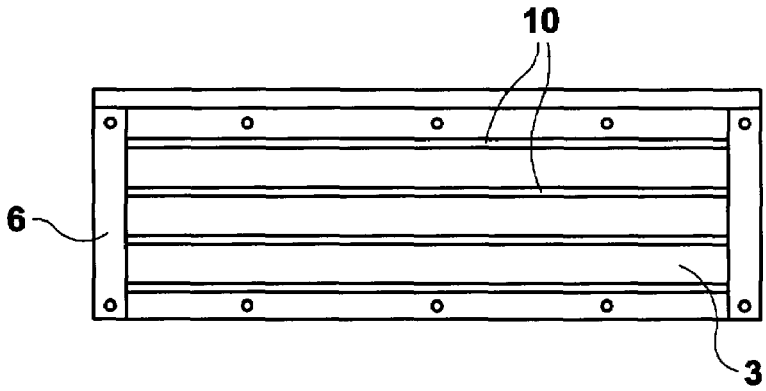
FIG. 4 is a bottom, plan view of a first embodiment.
Figure 2:
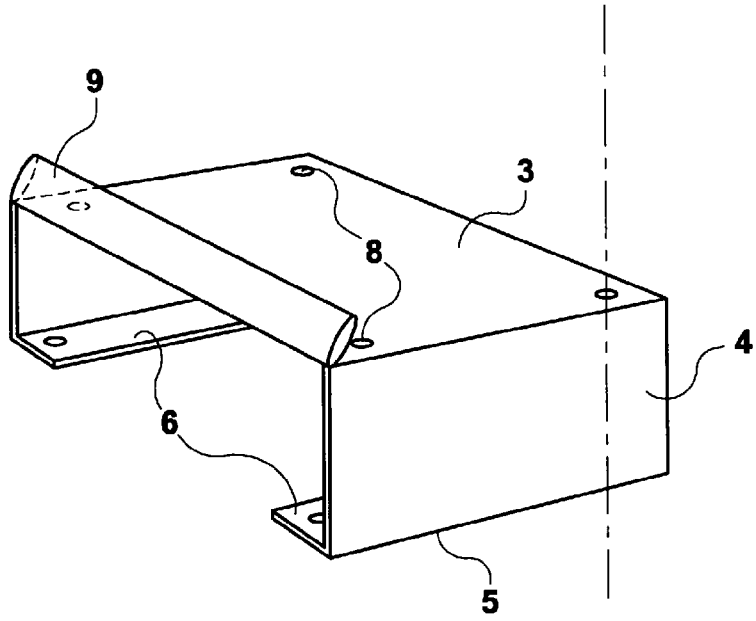
FIG. 2 is a top perspective view of a first embodiment according to the present invention.
Figure 3:
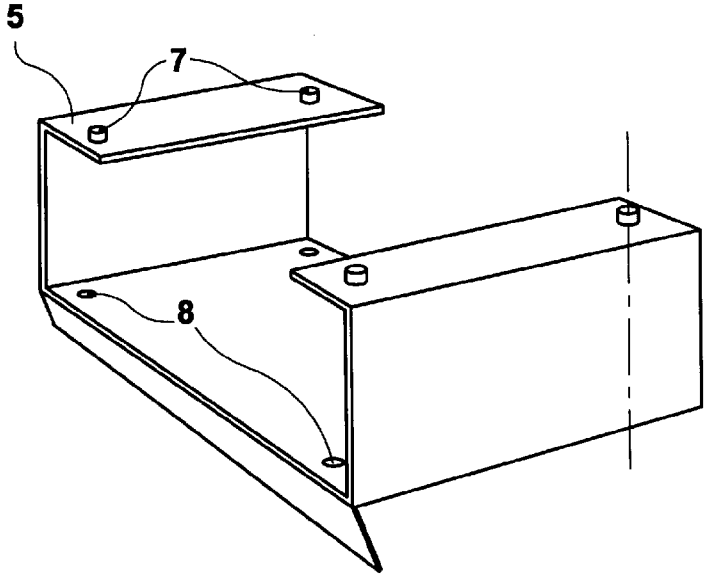
FIG. 3 is a bottom perspective view of a first embodiment according to the present invention.

The present invention relates to an auxiliary shelf system particularly designed for use with a gondola type shelf 1. Referring specifically to FIGS. 1-4, the device comprises an enclosure 2 having a substantially U-shaped cross-sectional configuration including a horizontal top wall 3 with a pair of sidewalls 4 perpendicularly depending therefrom. The sidewalls each terminate at a lower edge 5. Inwardly extending from the lower edge of each sidewall is a horizontal lip member 6. On the lower surface of each lip member are one or more pegs 7 for inserting into apertures 21 normally found on gondola shelves to anchor the enclosure thereon. Additionally, apertures 8 are positioned on the top wall to receive the pegs on the lower lip allowing a multiplicity of units to be fixedly stacked, if desired.

Angularly extending from a front edge of the top panel is an elongated receptacle 9 for slideably receiving pricing or other informational placards. Preferably, elongated ridges 10 are integrally formed with the upper surface of the top wall to enhance the structural integrity thereof.

Figure 5:
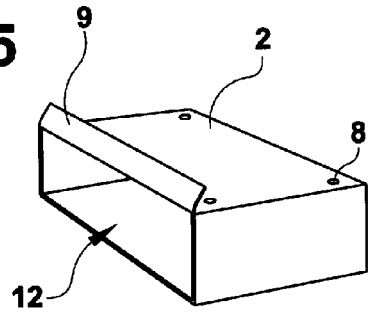
FIG. 5 depicts a second embodiment of the present invention.
Figure 6:
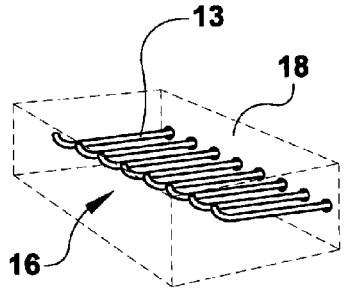
FIG. 6 depicts a slightly different embodiment than that depicted in FIG. 5.
Figure 7:
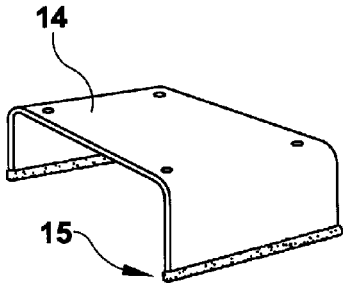
FIG. 7 depicts a third embodiment according to the present invention.
Figure 8:
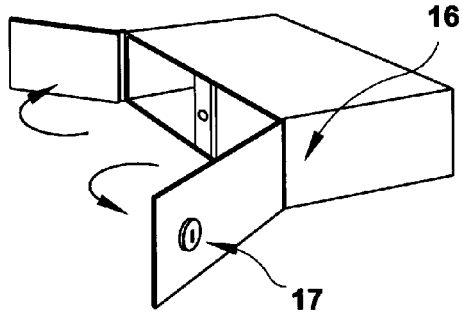
FIG. 8 depicts yet another embodiment of the present invention.

Now referring to FIGS. 5-8, the above described auxiliary shelf could include a horizontal lower wall 12 in lieu of the inwardly extending lips thereby providing a box-like enclosure. Other variations include a substantially U-shaped enclosure 14 whereby the sidewalls terminate at a lower edge having a rubber strip 15 thereon or a box-type enclosure 16 having one or more front panels 17 that can be locked to secure controlled merchandise. Additionally, a rear wall 18 may be included having apertures for receiving shelf mounted hangers 13 allowing the device to be mounted thereto.

With each of the variations, the placard receptacle and rear wall may be deleted if desired. The hanger apertures can be deleted from the rear wall to provide a completely encompassing enclosure. Additionally, any of the enclosure walls can include one or more perforated sections that can be removed to expose product.

The angle, size and shape of the placard receptacle can be varied as desired. With the hanger and aperture version, any number of apertures having any desired shape and size for accommodating any number or style of hanger can be used. Though the device is depicted and described as being primarily for use with an existing shelf system, the auxiliary shelf system according to the present invention can be used with any suitable support surface. The shelf system can be constructed with any suitable material such as plastic, metal, etc.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with an existing gondola shelf having a plurality of apertures thereon, an auxiliary shelf system comprising:

an enclosure having a substantially U-shaped cross-sectional configuration and having an open back and front, said enclosure including a horizontal top wall with a pair of sidewalls perpendicularly depending therefrom, said top wall having a front edge and a rear edge with an elongated receptacle angularly extending from the front edge toward the rear edge for slidably receiving an informational placard, each of said sidewalls terminating at a lower edge;

a horizontal lip member inwardly extending from the lower edge of each sidewall, said lip member having a lower surface with at least one peg thereon that is inserted into one of said apertures found on the gondola shelf to anchor the enclosure thereon;

at least one aperture positioned on the top wall of said enclosure for receiving another peg on another enclosure.

2. The auxiliary shelf system according to claim 1 wherein said top wall includes an upper surface having elongated ridges integrally formed therewith to enhance the structural integrity of said top wall.

* * * * *